US007363780B2

(12) United States Patent
Lee et al.

(10) Patent No.: US 7,363,780 B2
(45) Date of Patent: Apr. 29, 2008

(54) WASHING MACHINE HAVING FLOATING LAUNDRY DETECTING MEANS AND METHOD FOR CONTROLLING THE SAME

(75) Inventors: Deug Hee Lee, Kimhae-shi (KR); Seung Bong Choi, Changwon-shi (KR)

(73) Assignee: LG Electronics Inc., Seoul (KR)

( * ) Notice: Subject to any disclaimer, the term of this patent is extended or adjusted under 35 U.S.C. 154(b) by 595 days.

(21) Appl. No.: 10/703,450

(22) Filed: Nov. 10, 2003

(65) Prior Publication Data

US 2004/0139556 A1 Jul. 22, 2004

(30) Foreign Application Priority Data

| | | |
|---|---|---|
| Jan. 20, 2003 | (KR) | 10-2003-0003733 |
| Feb. 21, 2003 | (KR) | 10-2003-0011052 |
| Feb. 21, 2003 | (KR) | 10-2003-0011053 |
| Feb. 21, 2003 | (KR) | 10-2003-0011058 |
| Feb. 21, 2003 | (KR) | 10-2003-0011059 |
| Feb. 21, 2003 | (KR) | 10-2003-0011060 |
| Feb. 21, 2003 | (KR) | 10-2003-0011061 |
| Feb. 21, 2003 | (KR) | 10-2003-0011062 |
| Feb. 21, 2003 | (KR) | 10-2003-0011063 |

(51) Int. Cl.
*D06F 33/00* (2006.01)

(52) U.S. Cl. ..... 68/12.05; 68/12.21; 68/12.27

(58) Field of Classification Search ..... 68/12, 68/12.05, 12.27, 12.21
See application file for complete search history.

(56) References Cited

U.S. PATENT DOCUMENTS

| | | | | |
|---|---|---|---|---|
| 5,739,534 | A * | 4/1998 | Estenson et al. | 250/339.11 |
| 6,784,997 | B2 * | 8/2004 | Lorenz et al. | 356/429 |

FOREIGN PATENT DOCUMENTS

| | | | | |
|---|---|---|---|---|
| BE | 897098 | A | | 12/1983 |
| GB | 2068419 | A | | 8/1981 |
| JP | 03292998 | | | 12/1991 |
| JP | 03292998 | A | | 12/1991 |
| JP | 03292998 | A | * | 12/1991 |
| JP | 05-161776 | | | 6/1993 |
| JP | 10151291 | | | 9/1998 |
| JP | 10151291 | A | | 9/1998 |
| JP | 2002-210287 | | | 7/2002 |
| KR | 10-1998-0041190 | | | 8/1998 |
| KR | 10-1999-0069056 | | * | 9/1999 |

* cited by examiner

*Primary Examiner*—Michael Barr
*Assistant Examiner*—Jason Heckert
(74) *Attorney, Agent, or Firm*—McKenna Long & Aldridge LLP

(57) ABSTRACT

Washing machine having means for detecting floating laundry, such as a pillow, over a preset height, and method for controlling the same, which enables performance of washing without spray of water or causing damage to the laundry even if the laundry floats, the washing machine including an outer case, a water storage tub inside of the outer case, a washing tub rotatably mounted inside of the water storage tub, a driving motor for rotating the washing tub, and floating laundry detecting means for detecting a case when a height of laundry held in the washing tub is higher than a preset position.

1 Claim, 18 Drawing Sheets

WASHING MACHINE HAVING FLOATING LAUNDRY DETECTING MEANS AND METHOD FOR CONTROLLING THE SAME

This application claims the benefit of the Korean Patent Application Nos. P2003-0003733 filed on Jan. 20, 2003, and P2003-0011052, P2003-0011053, P2003-0011058, P2003-0011059, P2003-0011060, P2003-0011061, P2003-0011062 and P2003-0011063, and all filed on Feb. 21, 2003, all of which are hereby incorporated by reference for all purposes as if full set forth herein.

BACKGROUND OF THE INVENTION

1. Field of the Invention

The present invention relates to washing machines, and more particularly, to a washing machine having means for detecting floating laundry, such as a pillow, over a preset height, and a method for controlling the same, which enables progression of washing without spray of water or damaging the laundry even if the laundry floats.

2. Background of the Related Art

In general, the washing machine is an appliance in which various dirt stuck to clothes and beddings is removed by using softening action of detergent, friction of water circulation caused by rotation of washing blades, and impacts a pulsator applies to the laundry. An amount and kinds of the laundry may be detected by sensors; a washing process may be set automatically; washing water may be supplied to a proper level according to the amount and kinds of the laundry; and washing may occur under the control of a microcomputer.

In the meantime, a related art washing machine may be driven by transmitting a rotating power from a driving motor to a washing shaft through power transmission belt and pulleys to rotate a pulsator, or to a spinning shaft to rotate a washing and spinning tub, or by rotating the washing and spinning tub at different speeds in washing and spinning under the speed control of a brushless direct current (BLDC) motor.

Along with these, the related art washing machine may be driven by rotating only the pulsator at a low speed in washing, and rotating the pulsator and the spinning tub at a high speed and spinning simultaneously through different power transmission paths even though the BLDC motor is used. Penetration washing may be used in the related art washing machine. In penetration washing, water pumped to the washing tub is sprayed into the washing tub so that the water washes the laundry as the water penetrates through the laundry or washing blades are rotated in one direction at a high speed. FIG. 1 illustrates a section of a penetration washing machine, schematically.

Referring to FIG. 1, the related art penetration washing machine is provided with a water storage tub 2 supported on a plurality of supports 4 inside of an outer case 1, a washing tub 3 rotatably fixed to a washing shaft 6 inside of the washing tub 2 having a plurality of holes 3*a* in a wall for holding laundry, a pulsator 5 formed as a unit with the washing tub on an inside bottom thereof for forming water circulation, and a motor 7 under the water storage tub 2 on one side thereof for rotating the washing tub 3.

There are a tub cover 8 on a top of the water storage tub 2 for introducing the washing water rising through a gap between the washing tub 3 and the water storage tub into an inside of the washing tub, a water supply pipe 10 at one side of rear of the outer case 1 connected to an exterior for supplying the washing water to the washing tub 3, and a drain pipe 11 at one side of lower side of the water storage tub 2 for draining the washing water discharged through the holes 3*a* in the washing tub to an exterior finally.

There are a detergent box 12 on the water supply pipe 10 at one side of top of the washing tub 3 for automatic introduction of detergent by means of the washing water, and a balance weighter along a circumference of a top end of the washing tub 3 for prevention of vibration of the washing tub while it is spinning.

The penetration washing machine accomplishes a washing cycle by rotating the washing tub 3 and the pulsator 5 at a high speed in one direction. In detail, the laundry comes to make close contact with the inside surface of the washing tub as the washing tub 3 and the pulsator 5 rotate in one direction at a high speed. Washing water moving through the pass through holes 3*a* in the washing tub is re-introduced to the inside of the washing tub 3 again through the tub cover 8 and penetrates the laundry, to separate dirt from the laundry as this process is repeated.

Meanwhile, different from the foregoing system, there may be a system in which the pulsator 5, forming water circulation, is not formed as one unit with the washing tub 5, but formed separately.

That is, the washing tub 3 and the pulsator 5 are separate so that the direction of rotation of the washing tub 3 and the pulsator 5 are opposite in washing as the washing tub 3 rotates. In addition to this, there is a washing machine (see FIG. 2E) having a circulative water supply system in which water inside of the washing tub 3 is pumped to the inside of the washing tub 3 again by a pump P.

However, the foregoing different type of related art washing machines have the following problems in washing.

None of the related art washing machines is able to detect floating laundry, such as a pillow, and non performs a proper algorithm for coping with the floating laundry, which causes the following problems.

Referring to FIG. 2A, when laundry, such as a pillow, floats in an upper part of the washing tub 3, the floating laundry obstructs the water supply path, such that the water supply fails, or the water supplied to the washing machine splashes from the pillow to a space between the water storage tub 2 and the outer case 1.

Particularly, floating laundry causes problems for the different water supply methods including a first method in which the water is supplied when the washing tub 3 is stationary, a second method in which the water is supplied while the washing tub 3 is rotated, and a third method in combination of above two methods. If the laundry floats in the first method, the water supply passage is blocked if a water supply pressure is low or the water is splashed in all directions because it hits the floating laundry if the water supply pressure is high. If the laundry floats in the second method, the water is splashed in all directions from rotating laundry regardless of water supply pressure.

Next, referring to FIG. 2B, if the laundry floats higher than the washing tub 3 in a penetration washing, the washing water collides onto the floated laundry, and splashes in all direction therefrom, the washing water penetrates through the laundry, escapes through the holes 3*a*, and is introduced into the inside of the washing tub 3 again through the tub cover 8, to cause the washing water to enter into the space between the water storage tub 2 and the outer case 1.

Referring to FIG. 2C, in shower rinsing when the water is supplied while the water storage tub 2 is rotated, if the laundry floats higher than the washing tub 3, the water supplied for the shower rinsing is splashed from the laundry, to cause the water to enter into a space between the water storage tub 2 and the outer case 1, together with detergent.

Referring to FIG. 2D, if the washing tub 3 rotates at a high speed when the laundry, such as a pillow, floats higher than the washing tub 3, and may become in close contact to an inside circumferential surface of the tub cover 8 during spinning, causing damage to the laundry or causing the inside circumferential surface of the tub cover 8 to wear down.

Referring to FIG. 2E, in a pumping circulation method in which the washing water is pumped from the washing tub 3, to spray the washing water into the washing tub 3 through the water supply hole 40, or from a side of the washing tub 3, and the water storage tub 2 is rotated while the washing water is supplied in the shower ringing. If the laundry floats higher than the washing tub 3, the re-supplying water into the washing tub 3 after circulation is splashed from the laundry, to cause the washing water to enter into the gap between the water storage tub 3 and the outer case 1, together with the detergent.

In the meantime, when the washing water splashes from the floating laundry and enters into the gap between the water storage tub 2 and the outer case 1, the water infiltrates into an insulated part, to cause a safety problem, such as short circuit, or the like, or damages carpet when one is on the floor.

When the water splash caused by the floating laundry is intensive in the water supply, the water level cannot reach to a preset level, to require a long water supply time, which results in waste of water.

If the washing water is splashed to outside of the water storage tub 2 in the penetration washing, or in the circulative washing, other than the water supply, shortage of the washing water is caused to require re-supply of washing water.

In summary, since none of the related art washing machine and related art washing methods are able to detect floating laundry, and they fail to suggests a washing method for coping with the problem properly, there may be deterioration of washing performance and damage to the laundry caused by the shortage of water, to result in safety problems and waste of water.

SUMMARY OF THE INVENTION

Accordingly, the present invention is directed to a washing machine having floating laundry detecting means, and a method for controlling the same that substantially obviates one or more of the problems due to limitations and disadvantages of the related art.

An advantage of the present invention is to provide a washing machine having means for detecting floating laundry, such as a pillow, over a preset height, and a method for controlling the same, which can cope with the floating laundry properly, for performing smooth washing without waster splash or laundry damage caused by the floating laundry.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

To achieve these and other advantages and in accordance with the purpose of the present invention, as embodied and broadly described, the washing machine includes an outer case, a water storage tub inside of the outer case, a washing tub rotatably mounted inside of the water storage tub, a driving motor for rotating the washing tub, and floating laundry detecting means for detecting a case when a height of laundry held in the washing tub is higher than a preset position.

The floating laundry detecting means includes a light emitting part at one side of a tub cover on top of the water storage tub, and a light receiving part at the other side opposite to the light emitting part.

The floating laundry detecting means includes a light emitting part at one side of the tub cover on top of the water storage tub, a light receiving part at the other side opposite to the light emitting part, and a protection baffle provided around the light emitting part and the light receiving part.

The protection baffle is formed of a transparent material.

The floating laundry detecting means includes a light emitting part and a light receiving part fitted side by side at one side of the tub cover on top of the water storage tub, and a reflective plate fitted to the other side opposite to the light emitting part and the light receiving part.

The floating laundry detecting means includes a light emitting part and a light receiving part fitted side by side at one side of the tub cover on top of the water storage tub so as to slant a light path, and a reflective plate fitted to an outside circumference of a fluid balance provided to an upper part of the washing tub, with a slope so as to face the light emitting part and the light receiving part fitted to the tub cover.

The floating laundry detecting means is a distance detecting sensor fitted to a lid or the tub cover on top of the water storage tub, for detecting a distance to the floating laundry.

The distance detecting sensor has an ultrasonic sensor applied thereto.

The floating laundry detecting means includes an electrode sensor fitted to the tub cover on top of the water storage tub for detecting floating laundry when the floating laundry comes into contact thereto.

The floating laundry detecting means includes a floating preventer fitted to the tub cover on top of the water storage tub, and an electrode sensor fitted to the floating preventer.

The floating preventer is a net formed structure fitted to a position the washing water, supplied to the washing tub through the water supply hole, drops.

The electrode sensor is fitted to an outside surface of the floating preventer.

In another aspect of the present invention, there is provided a method for controlling a water supply cycle including the steps of supplying water, detecting if there is floating laundry or not, taking a counter measure for prevention of splash of water when the floating laundry is detected, checking whether a supplied water level is at a preset water level or not, determining happening of an occasion when the floating laundry is detected if the supplied water level is not reached to the preset water level, and taking the counter measure for prevention of splash of water continuously if it is determined that there is such an occasion happened, and stopping the water supply and finishing a water supply cycle if the water supply level is reached to the preset water level.

The step of taking the counter measure for prevention of splash of water includes the step of reducing a rotation speed of the washing tub in a case the water supplied is made while rotating the tub.

The step of taking the counter measure for prevention of splash of water includes the step of reducing a rotation speed of the washing tub, and issuing of an alarm in a case the water supplied is made while rotating the tub.

The step of taking the counter measure for prevention of splash of water further includes the step of stopping the water supply.

In further aspect of the present invention, there is provided a method for controlling a washing machine, including the steps of starting rotation of a tub and, at the same time with this, detecting if there is floating laundry or not, taking a counter measure for prevention of splash of water when the floating laundry is detected, checking whether a preset washing time period is reached or not, determining happening of an occasion when the floating laundry is detected if the preset washing time period is not reached, and taking the counter measure for prevention of splash of water continuously if it is determined that there is such an occasion happened, and stopping the washing and finishing a washing cycle if a washing time period is reached to the preset washing time period.

The step of taking the counter measure for prevention of splash of water includes the step of reducing a rotation speed of the washing tub.

The step of taking the counter measure for prevention of splash of water includes the step of stopping the washing tub and pulsating only a pulsator.

The step of taking the counter measure for prevention of splash of water includes the step of rotating the washing tub at a reduced speed in a reverse direction and pulsating a pulsator.

The step of taking the counter measure for prevention of splash of water includes the step of rotating the washing tub at a speed a compressed washing can be made.

The step of taking the counter measure for prevention of splash of water includes the step of pulsating the washing tub.

The step of taking the counter measure for prevention of splash of water includes the step of draining washing water to drop a water level.

The step of draining washing water for prevention of splash of water includes the step of draining the washing water to a level at which, when the washing tub is rotated at the highest speed, though there may be the water spray through the tub cover, there is no floating laundry detected.

The step of draining washing water for prevention of splash of water includes the step of draining the washing water to leave only a minimum level of water at which no spray of water through the tub cover is occurred even if the washing tub is rotated at the highest speed.

The step of taking the counter measure for prevention of splash of water further includes the step of stopping the washing.

In still another aspect of the present invention, there is provided a method for controlling a rinsing cycle including the steps of starting rotation of a tub and, at the same time with this, detecting if there is floating laundry or not, taking a counter measure for prevention of splash of water when the floating laundry is detected, checking whether a preset rinsing time period is reached or not, determining happening of an occasion when the floating laundry is detected if the preset rinsing time period is not reached, and taking the counter measure for prevention of splash of water continuously if it is determined that there is such an occasion happened, and stopping the rinsing and finishing a rinsing cycle if a rinsing time period is reached to the preset rinsing time period.

The step of taking the counter measure for prevention of splash of water includes the step of reducing a rotating speed of the washing tub.

The step of taking the counter measure for prevention of splash of water includes the step of reducing a rotating speed of the washing tub and, at the same time, issuing an alarm.

The step of taking the counter measure for prevention of splash of water further includes the step of stopping rinsing.

In still further aspect of the present invention, there is provided a method for controlling a rinsing cycle including the steps of making a shower water supply, starting rotation of a tub and, at the same time with this, detecting if there is floating laundry or not, taking a counter measure for prevention of splash of water when the floating laundry is detected, checking whether a preset rinsing time period is reached or not, determining happening of an occasion when the floating laundry is detected if the preset rinsing time period is not reached, and taking the counter measure for prevention of splash of water continuously if it is determined that there is such an occasion happened, and stopping the rinsing and finishing a rinsing cycle if a rinsing time period is reached to the preset rinsing time period.

The step of taking the counter measure for prevention of splash of water includes the step of reducing a rotating speed of the washing tub.

The step of taking the counter measure for prevention of splash of water includes the step of reducing a rotating speed of the washing tub and, at the same time, issuing an alarm.

The step of taking the counter measure for prevention of splash of water further includes the step of stopping rinsing.

In still yet further aspect of the present invention, there is provided a method for controlling a spinning, including the steps of starting rotation of a tub and, at the same time with this, detecting if there is floating laundry or not, taking a counter measure for prevention of cloth damage and wear down of a tub cover when the floating laundry is detected, checking whether a preset spinning time period is reached or not, determining happening of an occasion when the floating laundry is detected if the preset spinning time period is not reached, and taking the counter measure for prevention of cloth damage and wear down of a tub cover continuously if it is determined that there is such an occasion happened, and stopping the spinning and finishing a spinning cycle if a spinning time period is reached to the preset spinning time period.

The step of taking a counter measure for prevention of cloth damage and wear down of a tub cover includes the step of reducing a rotation speed of the washing tub.

The step of taking a counter measure for prevention of cloth damage and wear down of a tub cover includes the step of reducing a rotation speed of the washing tub and issuing an alarm.

The step of taking a counter measure for prevention of cloth damage and wear down of a tub cover further includes the step of stopping spinning.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention:

In the drawings:

FIGS. 2A-2E illustrate reference drawings for describing problems of different kinds of related art washing machines, wherein FIG. 2A illustrates a diagram showing key parts for describing problems in water supply, FIG. 2B illustrates a diagram showing key parts for describing problems in penetration washing, FIG. 2C illustrates a diagram showing key parts for describing problems in shower rinsing, FIG. 2D illustrates a diagram showing key parts for describing problems in spinning, and FIG. 2E illustrates a diagram showing key parts for describing problems related to a pumping circulative type washing machine;

DETAILED DESCRIPTION OF THE ILLUSTRATED EMBODIMENTS

Figure 1:
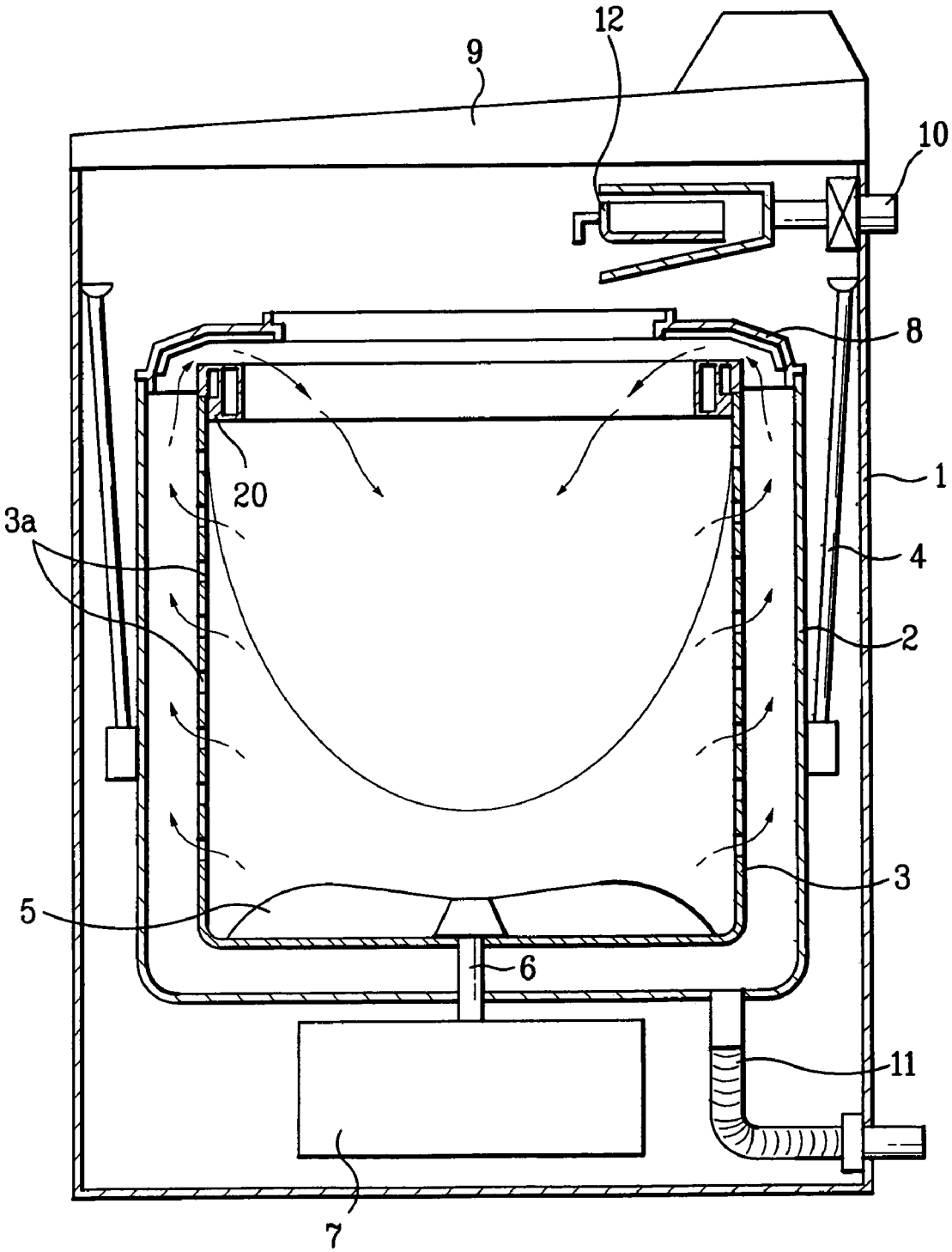
FIG.1 Related Art
FIG. 1 illustrates a section of a penetration washing machine, schematically.
Figure 2A:
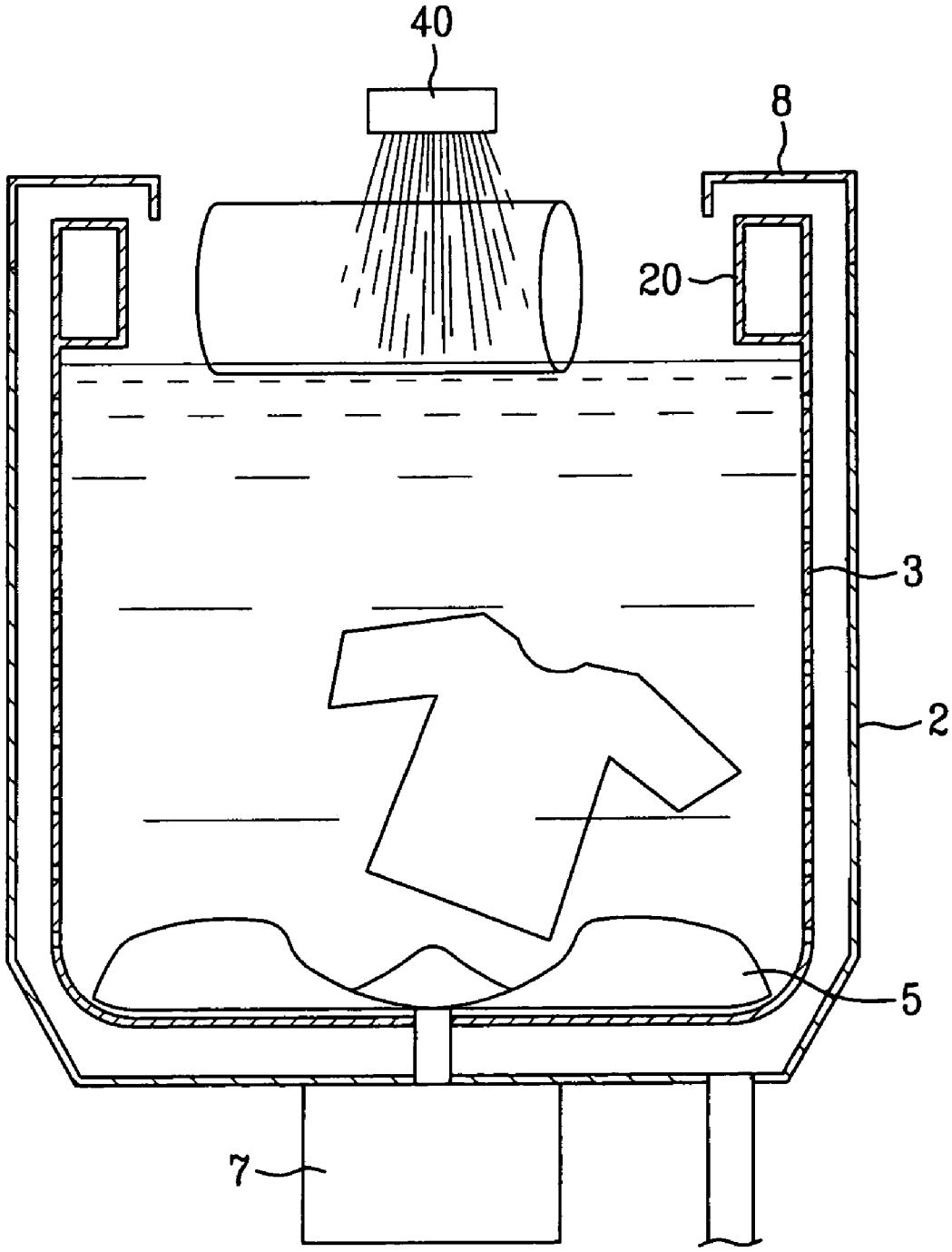
FIG.2A Related Art
Figure 2B:
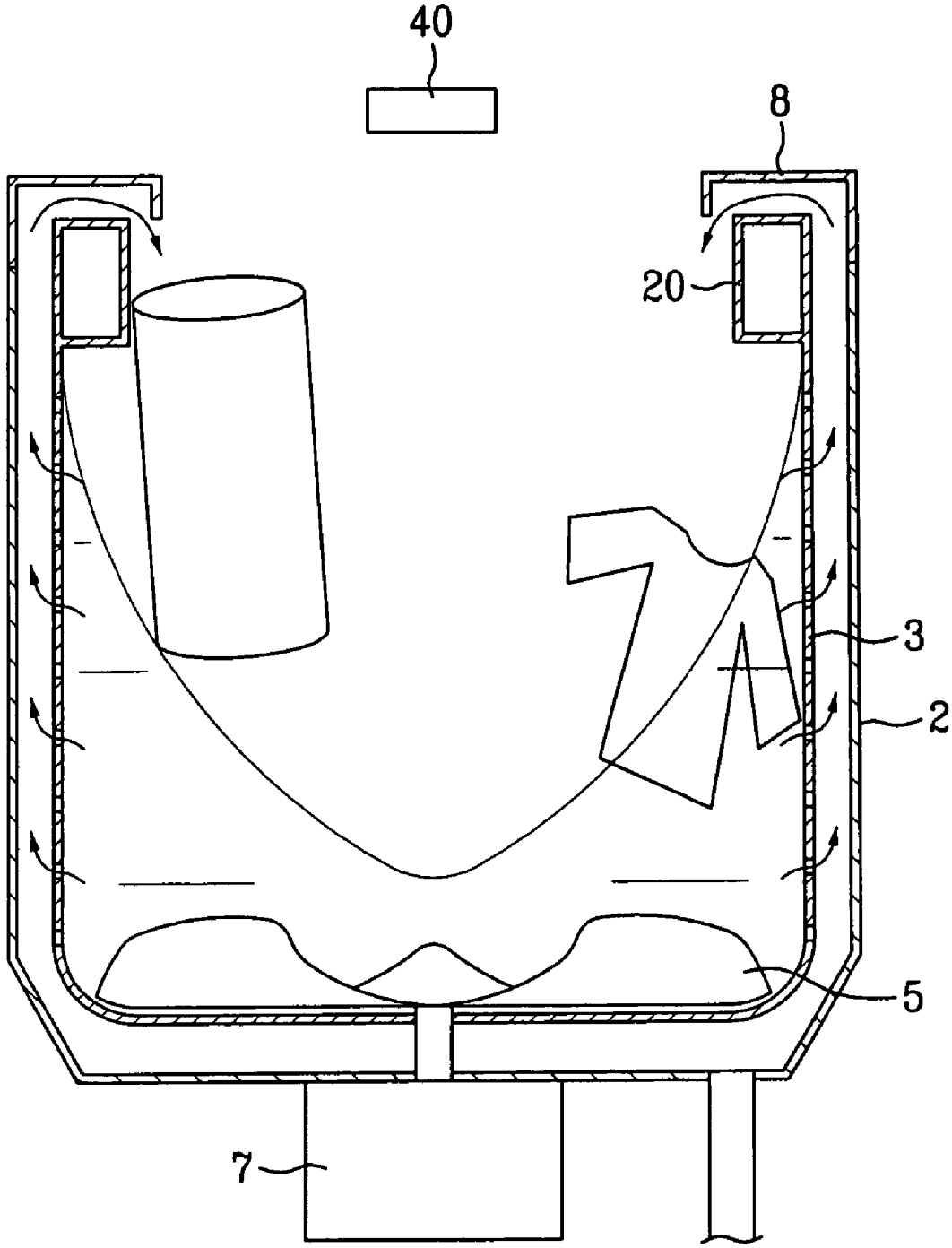
FIG.2B Related Art
Figure 2C:
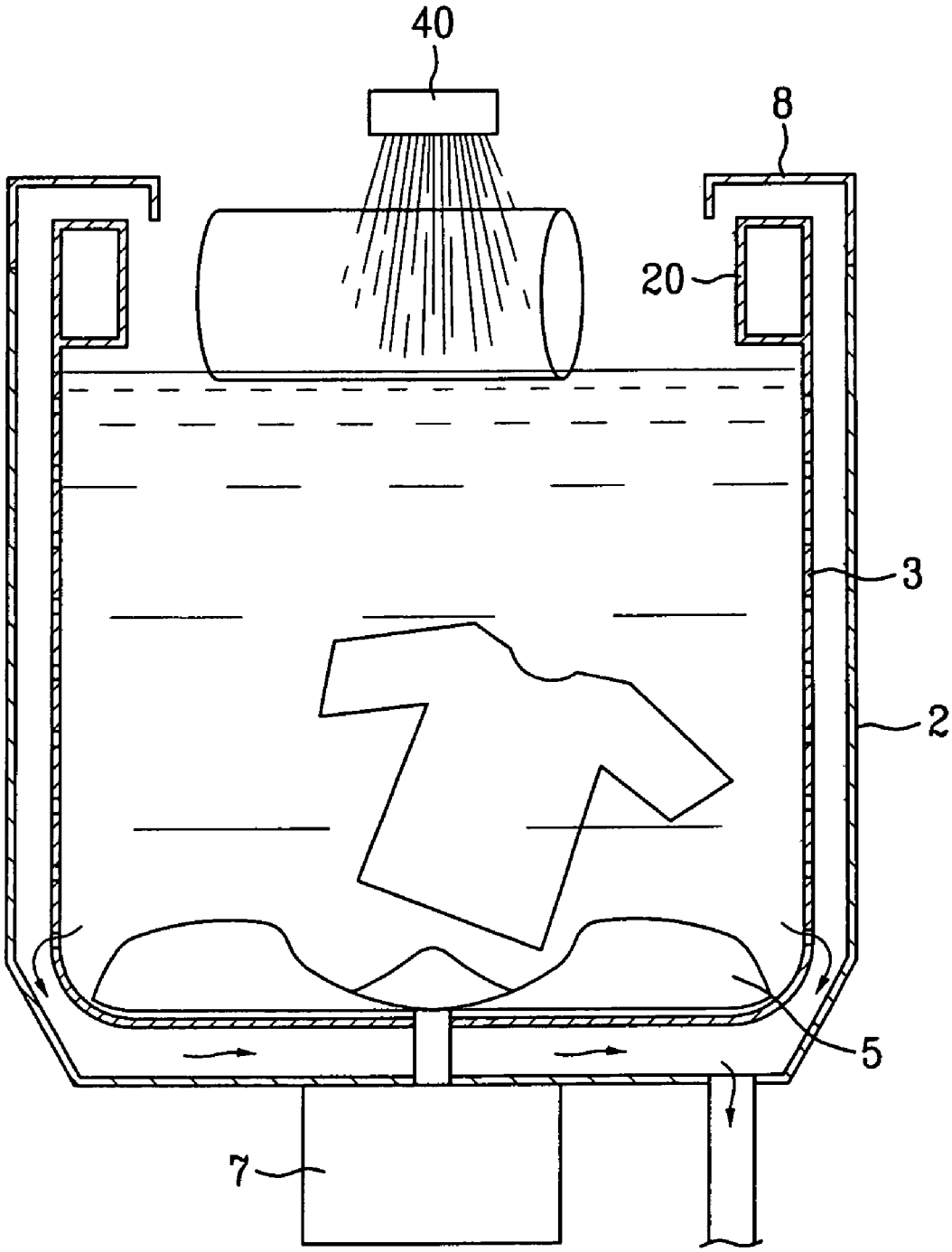
FIG.2C Related Art
Figure 2D:
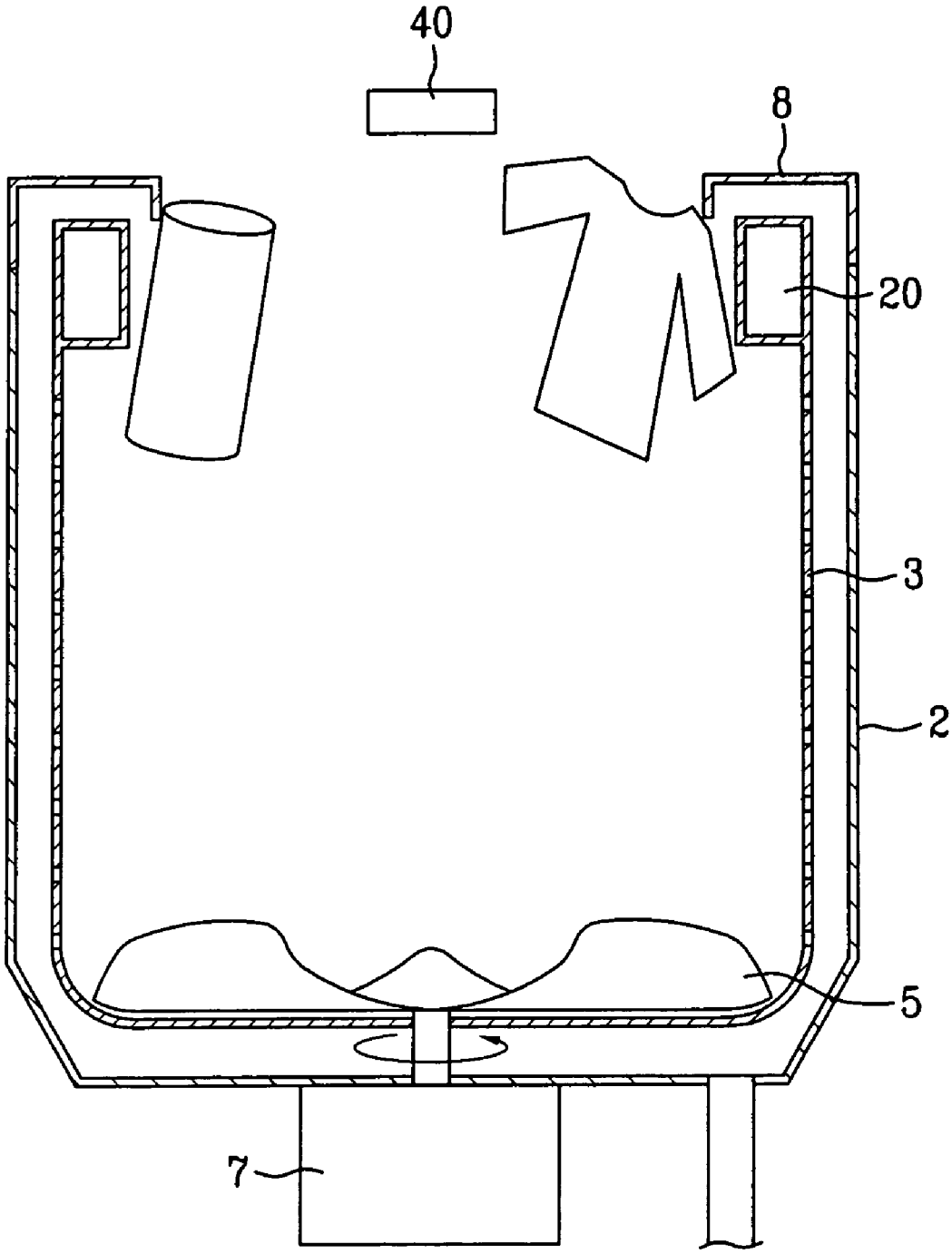
FIG.2D Related Art
Figure 2E:
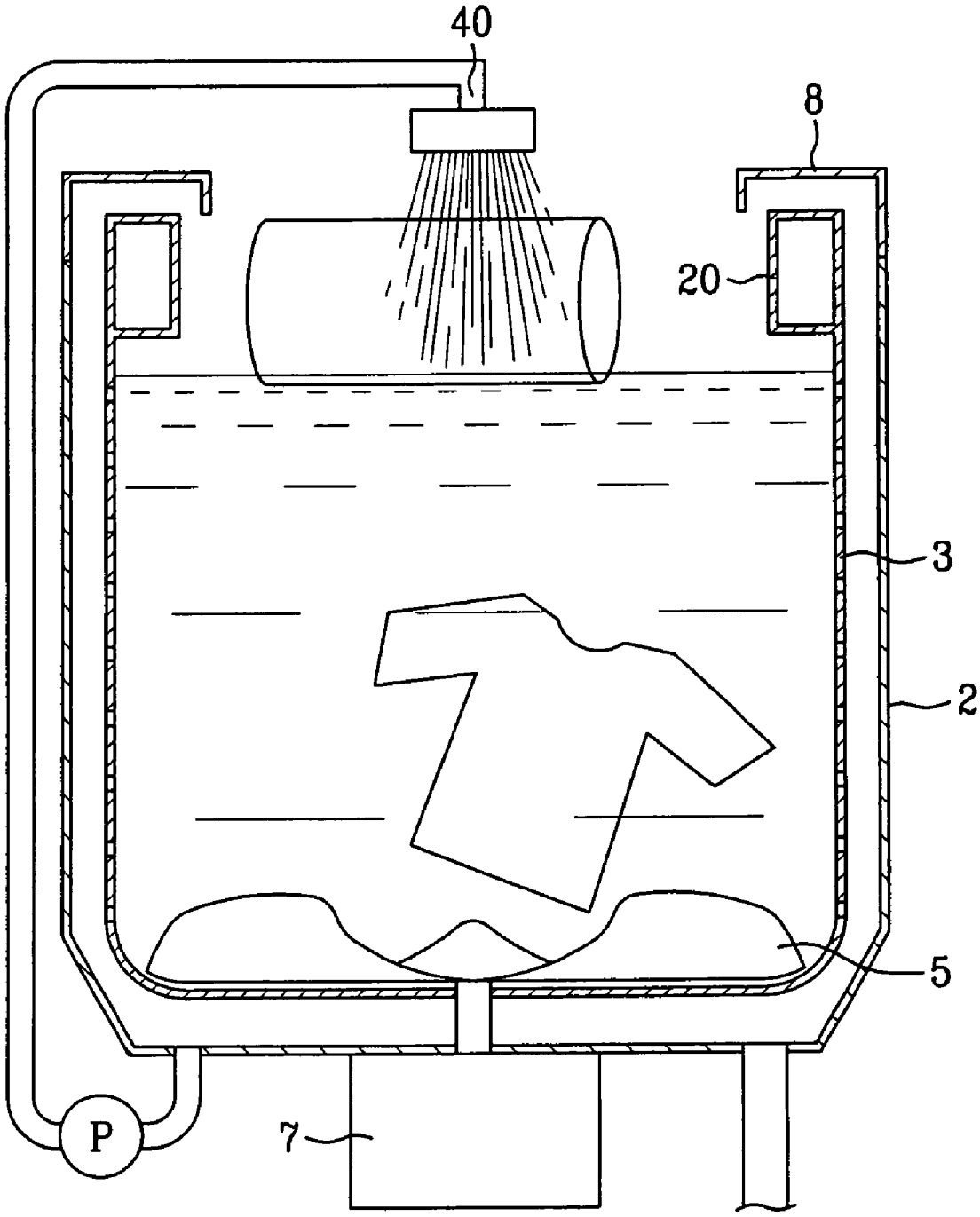
FIG.2E Related Art

Reference will now be made in detail to the embodiments of the present invention, examples of which are illustrated in the accompanying drawings FIGS. 3-9.

Each of the washing machines in accordance with embodiments of the present invention includes, in common, an outer case 1, a water storage tub 2 inside of the outer case 1, a tub cover 8 on top of the water storage tub 2, a washing tub 3 rotatably mounted inside of the water storage tub 2, a driving motor 7 for rotating the washing tub 3, and floating laundry detecting means for detecting a case when a height of laundry held in the washing tub 3 is higher than a preset position.

Figure 3:
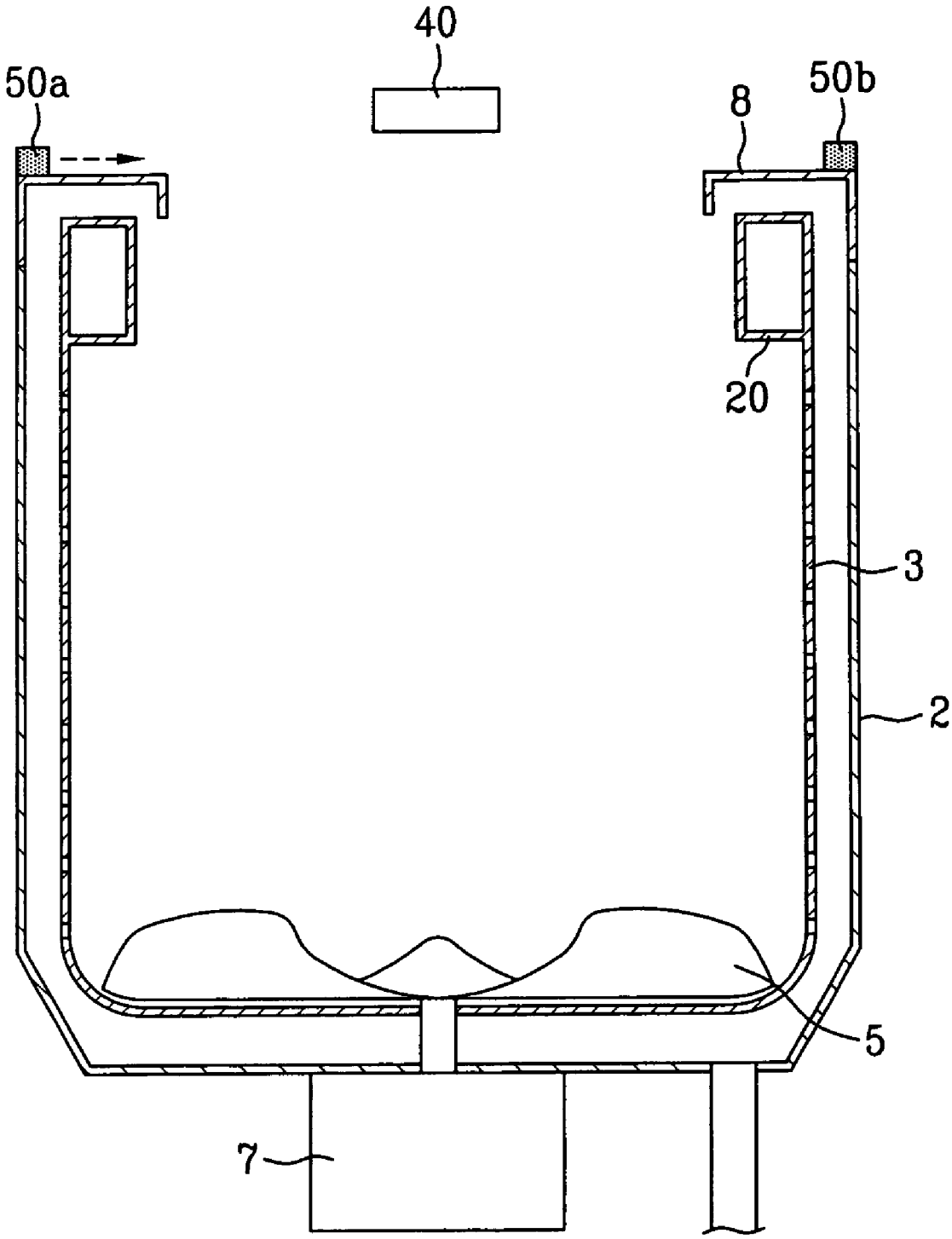
FIG. 3 illustrates a diagram showing an exemplary structure of a washing machine having floating laundry detecting means in accordance with a first embodiment of the present invention applied thereto.

FIG. 3 illustrates a diagram showing an exemplary structure of a washing machine having floating laundry detecting means in accordance with a first embodiment of the present invention applied thereto.

Referring to FIG. 3, the floating laundry detecting means includes a light emitting part 50*a* at one side of the tub cover 8 on top of the water storage tub 2, and a light receiving part 50*b* at the other side opposite to the light emitting part 50*a*.

According to the floating laundry detecting means in accordance with the first embodiment of the present invention, when the laundry floats over a height the light emitting part 50*a* and the light receiving part 50*b* are fitted thereto, a light directed from the light emitting part 50*a* to the light receiving part 50*b* is cut off (or blocked by the floating pieces of laundry), thus, the floating of laundry can be detected. A path of light is illustrated by an arrow in the figures.

In the meantime, though FIG. 3 illustrates a case when the floating laundry detecting means including the light emitting part 50*a* and the light receiving part 50*b* at the other side opposite thereto, is fitted to top of the tub cover 8, the present invention is not necessarily limited thereto. That is, a position for fitting the floating laundry detecting means is not limited, such that the floating laundry detecting means may be fitted to an inside circumference of the tub cover 8.

Figure 4:
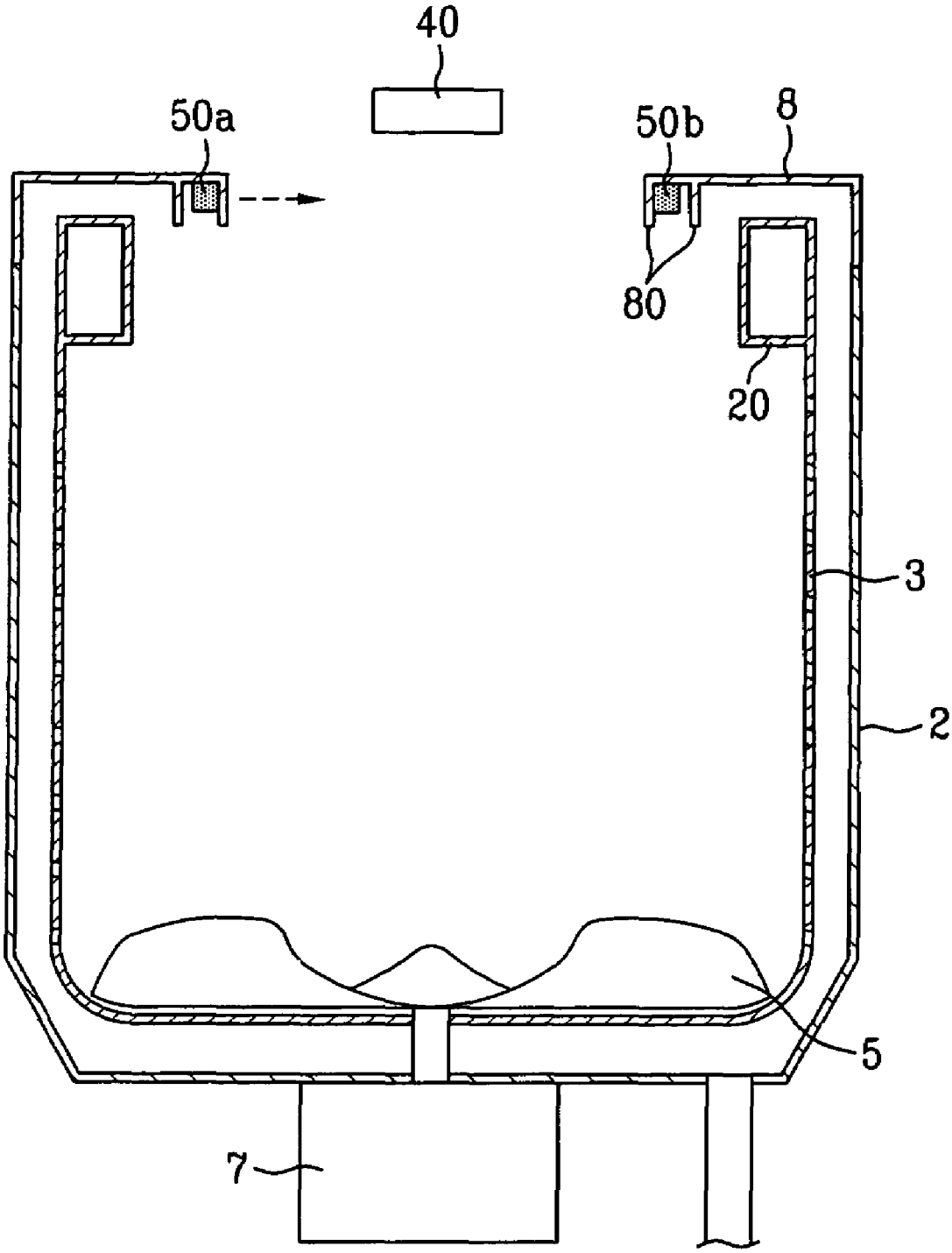
FIG. 4 illustrates a diagram showing an exemplary structure of a washing machine having floating laundry detecting means in accordance with a second embodiment of the present invention applied thereto.

FIG. 4 illustrates a diagram showing an exemplary structure of a washing machine having floating laundry detecting means in accordance with a second embodiment of the present invention applied thereto.

Referring to FIG. 4, the floating laundry detecting means includes a light emitting part 50*a* at one side of the tub cover 8 on top of the water storage tub 2, a light receiving part 50*b* at the other side opposite to the light emitting part 50*a*, and a protection baffle 80 provided around the light emitting part 50*a* and the light receiving part 50*b*. The protection baffle 80 is formed of a transparent material for enabling transmission of a light to make the sensors operative.

According to the floating laundry detecting means in accordance with the second embodiment of the present invention, like the first embodiment, when the laundry floats over the level of the light emitting part 50*a* and the light receiving part 50*b*, light directed from the light emitting part 50*a* to the light receiving part 50*b* is blocked by the floating laundry and thus the floating of laundry can be detected. By providing the transparent protection baffles 80 around the light emitting part 50*a* and the light receiving part 50*b* on the tub cover 8, light sensors can be better protected.

Figure 5:
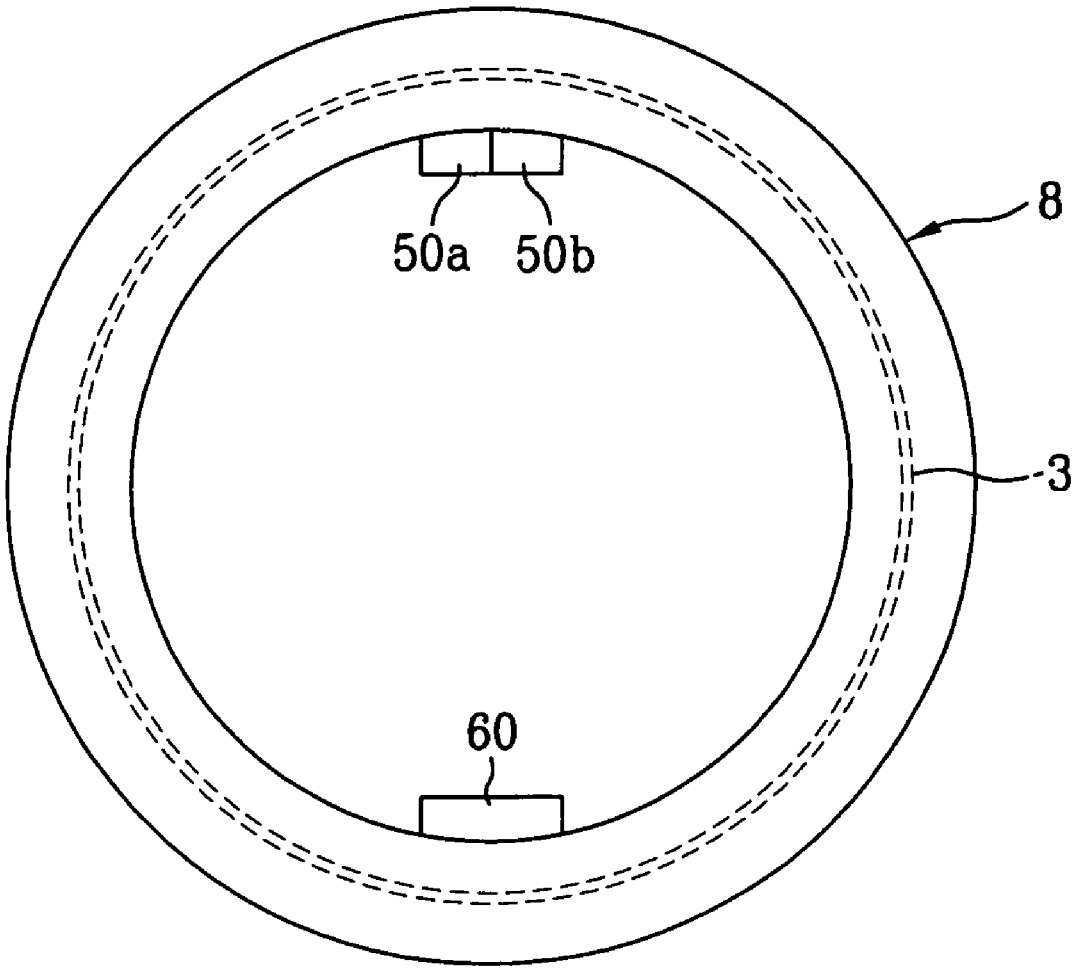
FIG. 5 illustrates a plan view showing an exemplary structure of a washing machine having floating laundry detecting means in accordance with a third embodiment of the present invention applied thereto.

FIG. 5 illustrates a plan view showing an exemplary structure of a washing machine having floating laundry detecting means in accordance with a third embodiment of the present invention applied thereto.

Referring to FIG. 5, the floating laundry detecting means includes a light emitting part 50*a* and a light receiving part 50*b* fitted side by side at one side of the tub cover 8 on top of the water storage tub 2, and a reflective plate 60 fitted to the other side opposite to the light emitting part 50*a* and the light receiving part 50*b*.

According to the floating laundry detecting means in accordance with the third embodiment of the present invention, when the laundry floats over the level of the light emitting part 50*a* and the light receiving part 50*b*, light directed from the light emitting part 50*a* to the reflective plate 60 is blocked by the floating laundry, thus the floating of laundry can be detected.

Though the reflective plate 60 fitted to the side of the tub cover 8 opposite to the light emitting part 50*a* and the light receiving part 50*b* projects from the tub cover 8, the reflective plate 60 may be fitted to an inside of the tub cover 8 so as not to be projected, i.e., so that it is substantially flush with or recessed into the tub cover 8.

Figure 6:
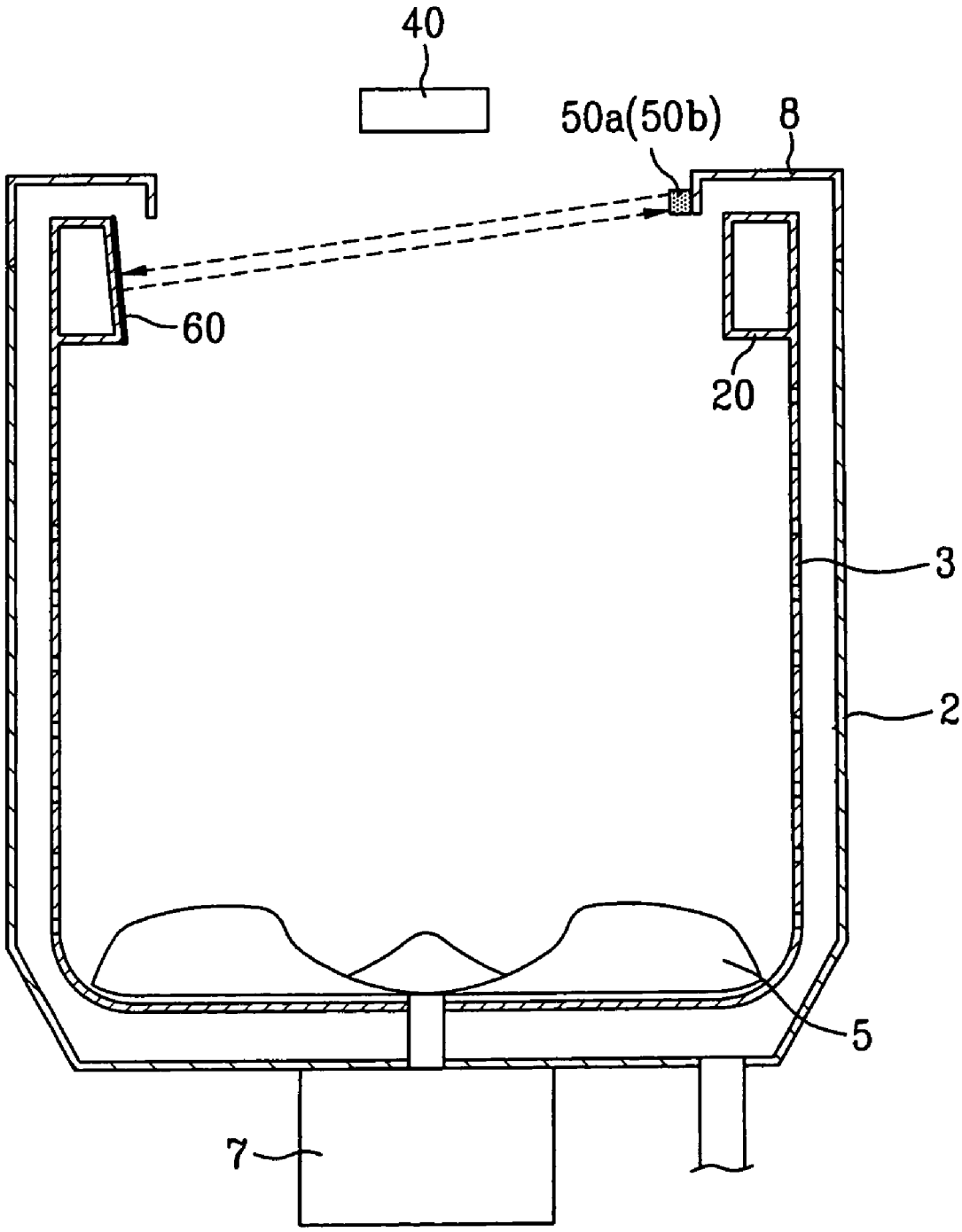
FIG. 6 illustrates a diagram showing an exemplary structure of a washing machine having floating laundry detecting means in accordance with a fourth embodiment of the present invention applied thereto.

FIG. 6 illustrates a diagram showing an exemplary structure of a washing machine having floating laundry detecting means in accordance with a fourth embodiment of the present invention applied thereto.

Referring to FIG. 6, the floating laundry detecting means includes a light emitting part 50*a* and a light receiving part 50*b* fitted side by side at one side of the tub cover 8 on top of the water storage tub 2 so as to slant a light path, and a reflective plate 60 fitted to an outside circumference of a fluid balance provided to an upper part of the washing tub 3, with a slope so as to face the light emitting part 50*a* and the light receiving part 50*b* fitted to the tub cover 8.

According to the floating laundry detecting means in accordance with the fourth embodiment of the present invention, like the third embodiment, when the laundry floats over the level of the light emitting part 50*a* and the light receiving part 50*b*, light directed from the light emitting part 50*a* to the reflective plate 60 is blocked by the following laundry, thus by the floating of laundry can be detected.

Figure 7:
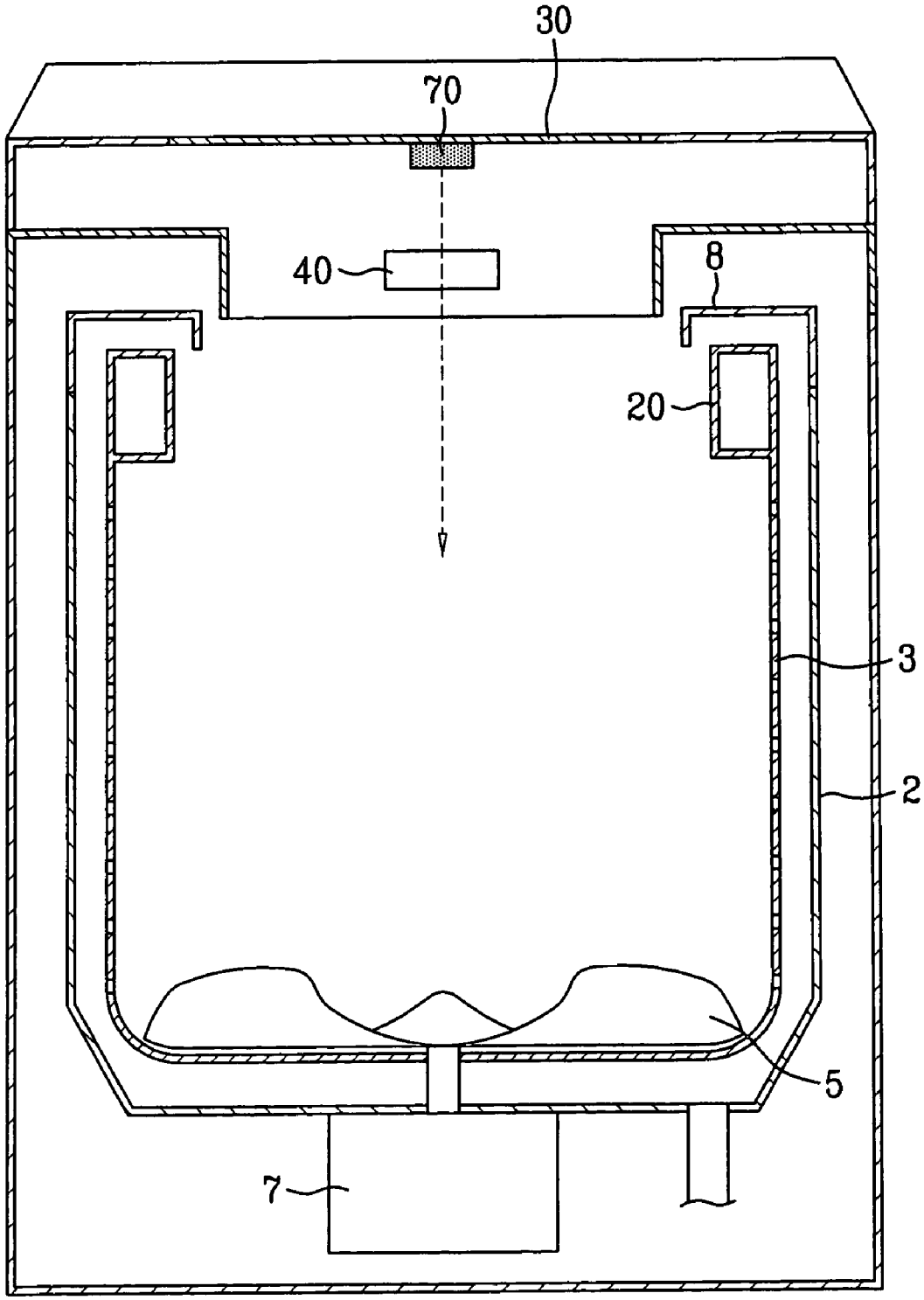
FIG. 7 illustrates a diagram showing an exemplary structure of a washing machine having floating laundry detecting means in accordance with a fifth embodiment of the present invention applied thereto.

FIG. 7 illustrates a diagram showing an exemplary structure of a washing machine having floating laundry detecting means in accordance with a fifth embodiment of the present invention applied thereto.

Referring to FIG. 7, the floating laundry detecting means is a distance detecting sensor 70 fitted to a lid 30 or the tub cover 8 on top of the water storage tub 2, for detecting a distance to the laundry. The distance detecting sensor 70 may be an ultrasonic sensor.

According to the floating laundry detecting means in accordance with the fifth preferred embodiment of the present invention, when a distance between laundry and the distance detecting senor 70 fitted to the lid 30 or the tub cover 8 on top of the water storage tub 2 is within a preset range, it is determined that there is laundry floating.

Figure 8:
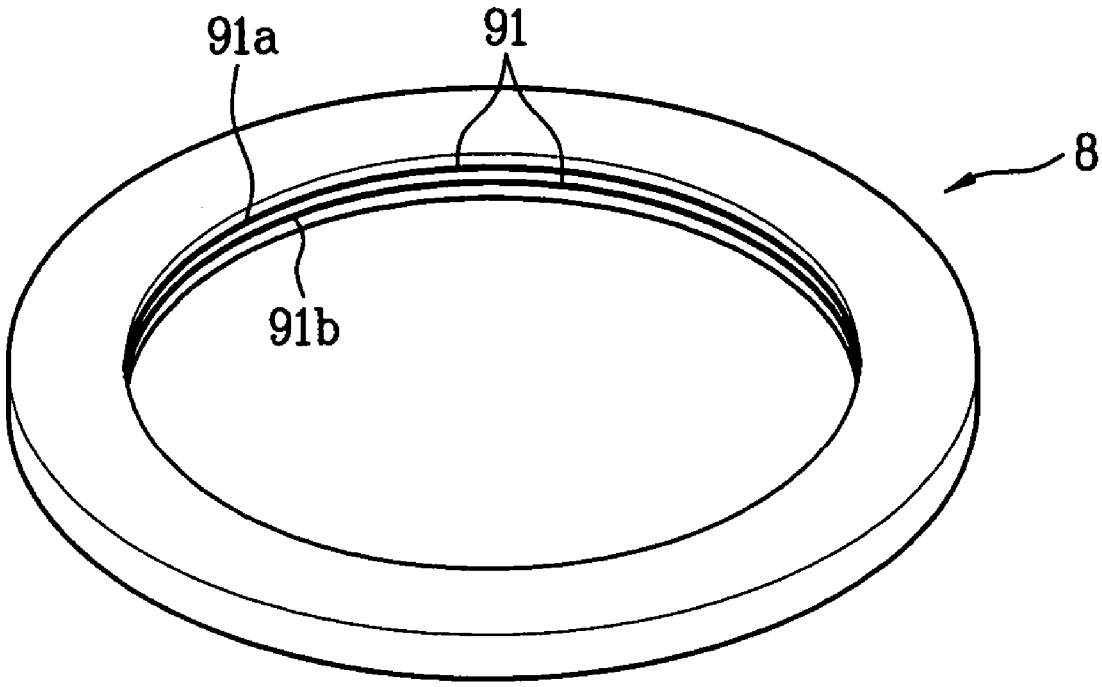
FIG. 8 illustrates a perspective view of key parts showing an exemplary structure of a washing machine having floating laundry detecting means in accordance with a sixth embodiment of the present invention applied thereto.

FIG. 8 illustrates a perspective view of key parts showing an exemplary structure of a washing machine having floating laundry detecting means in accordance with a sixth embodiment of the present invention applied thereto.

Referring to FIG. 8, the floating laundry detecting means includes an electrode sensor 91 fitted to the tub cover 8 on top of the water storage tub 2 for detecting floating laundry when the floating laundry comes into contact thereto. The electrode sensor 91 may include at least two electrodes 91*a* and 91*b*.

According to the floating laundry detecting means in accordance with the sixth embodiment of the present invention, when the laundry floats to a position higher than a position the electrode sensor 91 coming into contact with two electrodes at the same time, by reading a change of resistance between the two electrodes 91*a* and 91*b*, floating of the laundry can be detected.

Figure 9A:
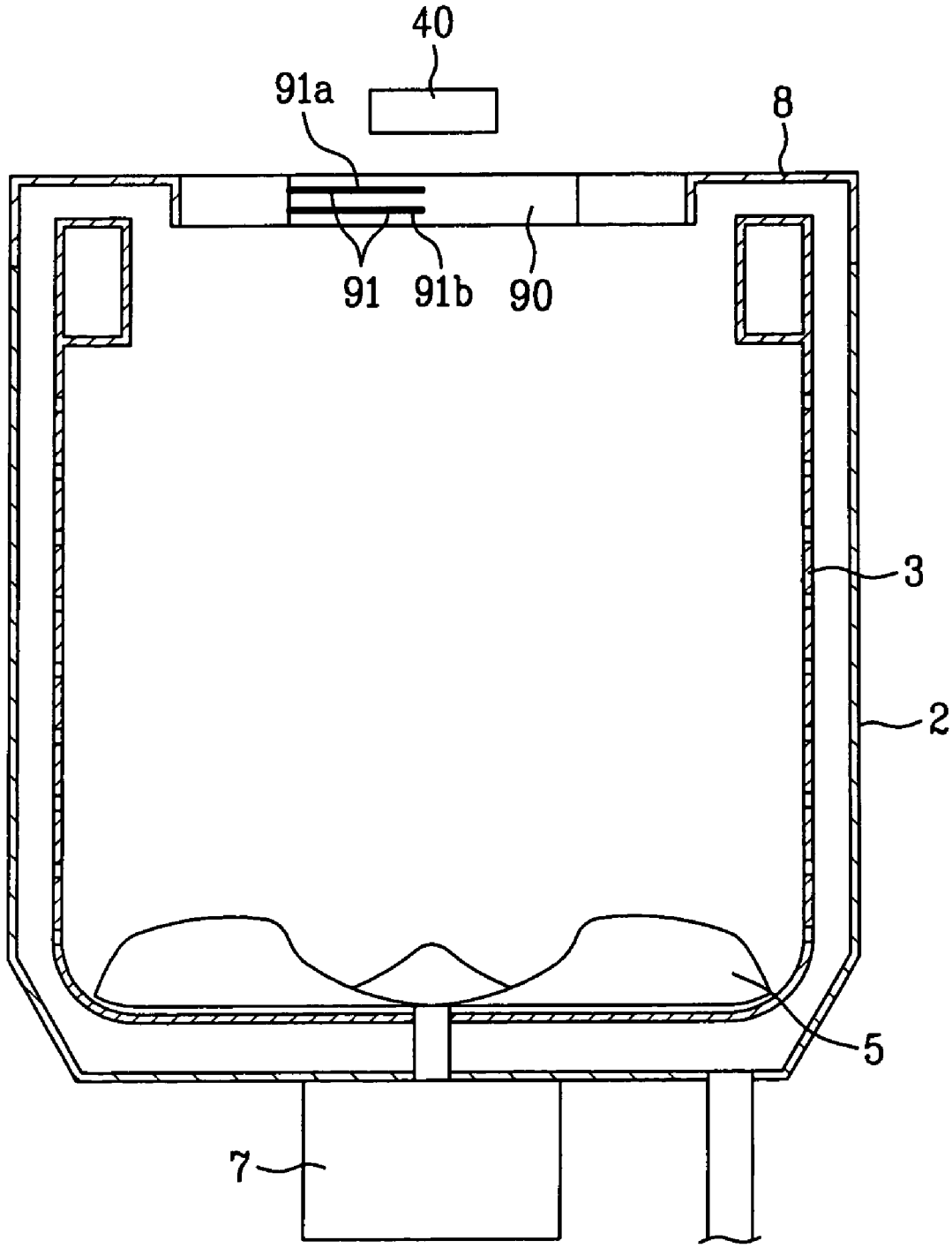
FIG. 9A illustrates a diagram showing an exemplary structure of a washing machine having floating laundry detecting means in accordance with a seventh embodiment of the present invention applied thereto.
Figure 9B:
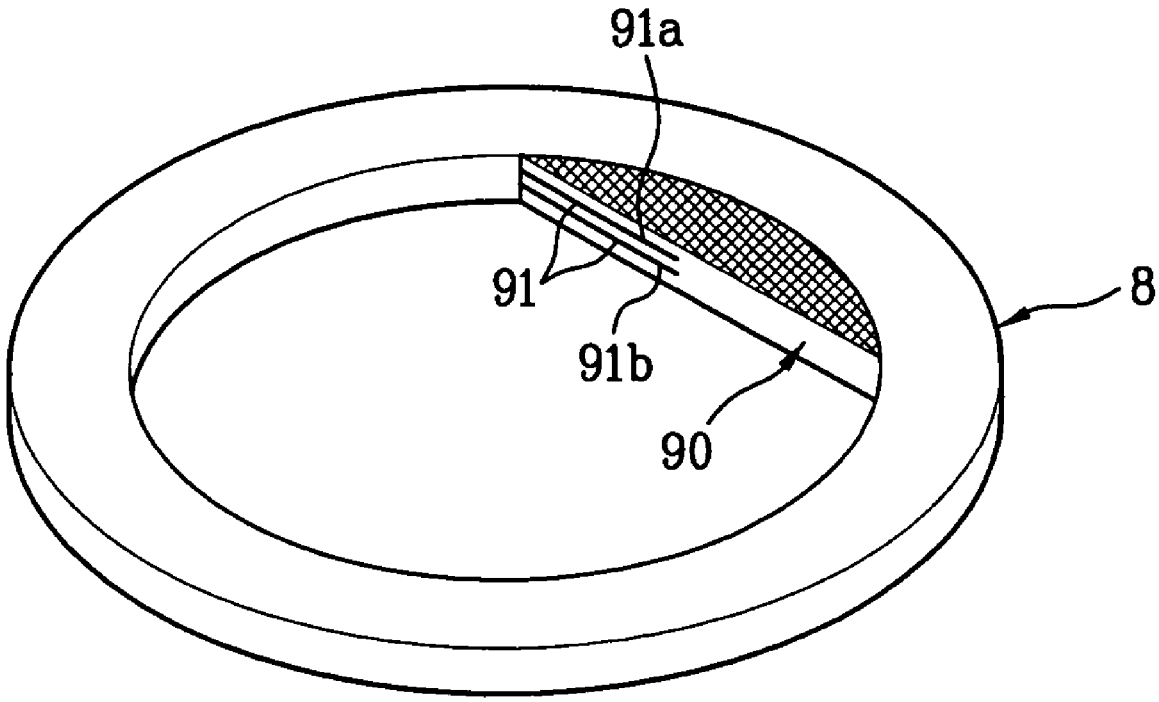
FIG. 9B illustrates a perspective view of part of FIG. 9A.

FIG. 9A illustrates a diagram showing an exemplary structure of a washing machine having floating laundry detecting means in accordance with a seventh embodiment of the present invention applied thereto, and FIG. 9B illustrates a perspective view of part of FIG. 9A.

Referring to FIGS. 9A and 9B, the floating laundry detecting means includes a floating preventer 90 fitted to the tub cover 8 on top of the water storage tub 2, and an electrode sensor 91 fitted to the floating preventer 90. The floating preventer 90 may be a net-like structure near or fitted to a position where the washing water, supplied to the washing tub 3 through the water supply hole 40, drops. The electrode sensor 91 is fitted to an outside surface of the floating preventer 90. The electrode sensor 91 may include at least two electrodes 91*a* and 91*b*.

According to the floating laundry detecting means in accordance with the seventh embodiment of the present invention, when the laundry floats to a position in the vicinity of the floating preventer 90 having the electrode sensor 91 is fitted thereto, and comes into contact with electrode sensor 91, by reading a change of resistance between two electrodes 91*a* and 91*b* of the electrode sensor 91, floating of the laundry can be detected.

In addition to this, the net-like floating preventer 90 in the seventh embodiment of the present invention prevents splashing of the water supplied through the water supply hole 40. That is, the floating preventer 90, near or fitted to a side of the water supply hole 40 on the tub cover 8, obstructs floatation of the laundry such that the laundry cannot come over the floating preventer 90, but remains under the floating preventer 90, at least in a region neighboring the water supply hole 40.

Figure 10:
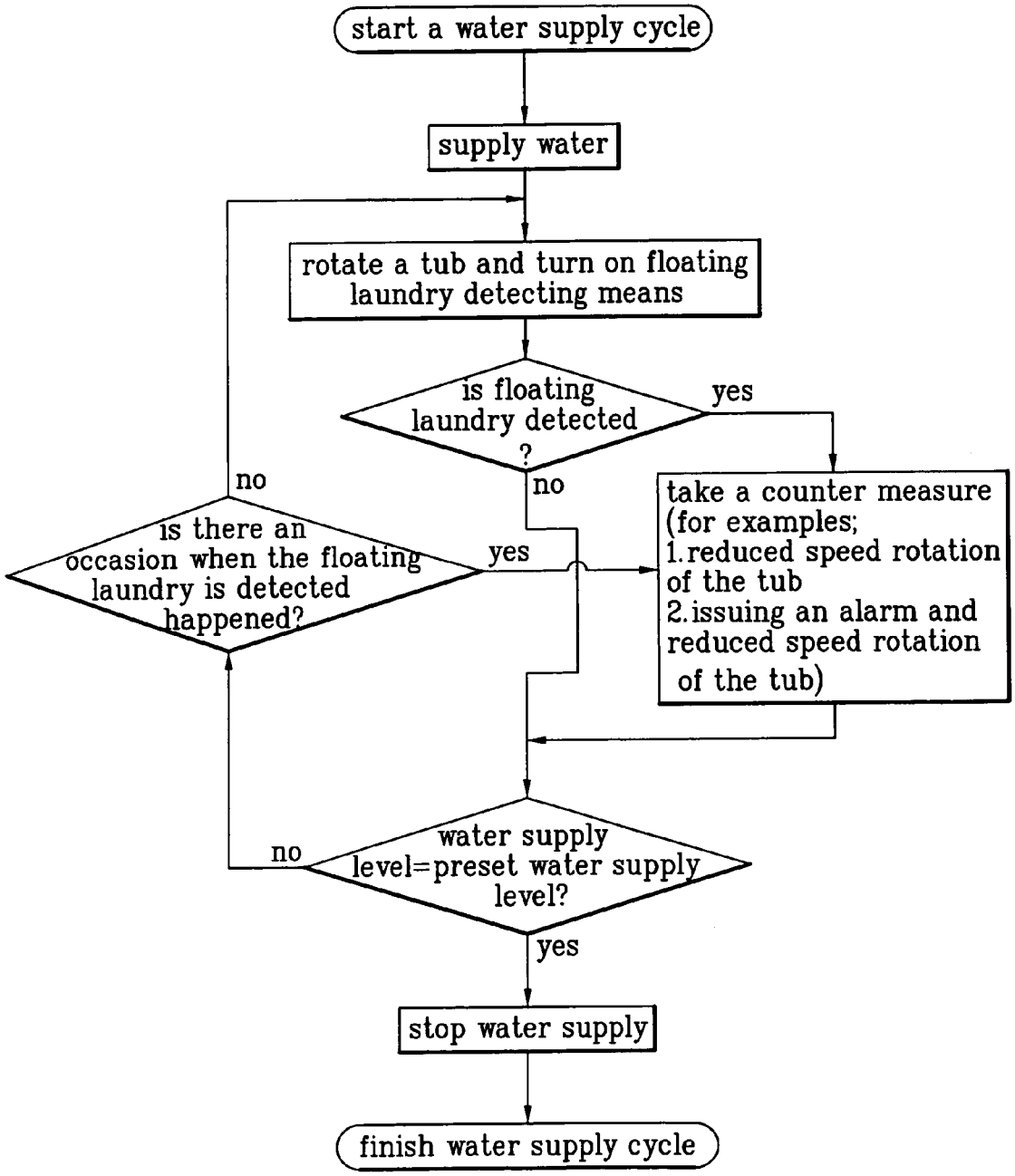
FIG. 10 illustrates a flow chart showing the steps of a process for controlling a water supply cycle in a method for controlling a washing machine in accordance with a first embodiment of the present invention.

A method for controlling a washing machine having the floating laundry detecting means in accordance with any one of the first to seventh embodiments of the present invention applied thereto will be described. FIG. 10 illustrates a flow chart showing the steps of a process for controlling a water supply cycle in a method for controlling a washing machine in accordance with an embodiment of the present invention. A process for controlling a water supply cycle will be described with reference to FIG. 10.

Supply of water is started, and at the same time with this, the washing tub 3 is rotated and floating laundry detecting means is turned on to detect if there is floating laundry. As a result, if it is determined that there is floating laundry by the detection of the floating laundry detecting means, a counter measure is taken for prevention of splash of the water.

According to the counter measure for prevention of splash of the water, while supplying water, a level of the supplied water is checked continuously whether the supplied water reaches a preset level or not.

In this instance, if floating laundry is detected and the supplied water level does not reach the preset level yet, the counter measure for prevention of splash of the water is conducted continuously. In a case the supplied water level reaches the preset level, the water supply is stopped and the water supply cycle is finished.

In the meantime, in above process, the counter measure for prevention of splash of the water may be reduction of rotation speed of the washing tub 3 if water is being supplied while rotating the washing tub 3. The counter measure for prevention of splash of the water may be reduction of rotation speed of the washing tub 3 together with issuing an alarm if water is being supplied while rotating the washing tub 3. The counter measure for prevention of splash of the water may be stopping of water supply.

A process for controlling a washing cycle in a method for controlling a washing machine in accordance with another embodiment of the present invention will be described, with reference to FIG. 11.

Figure 11:
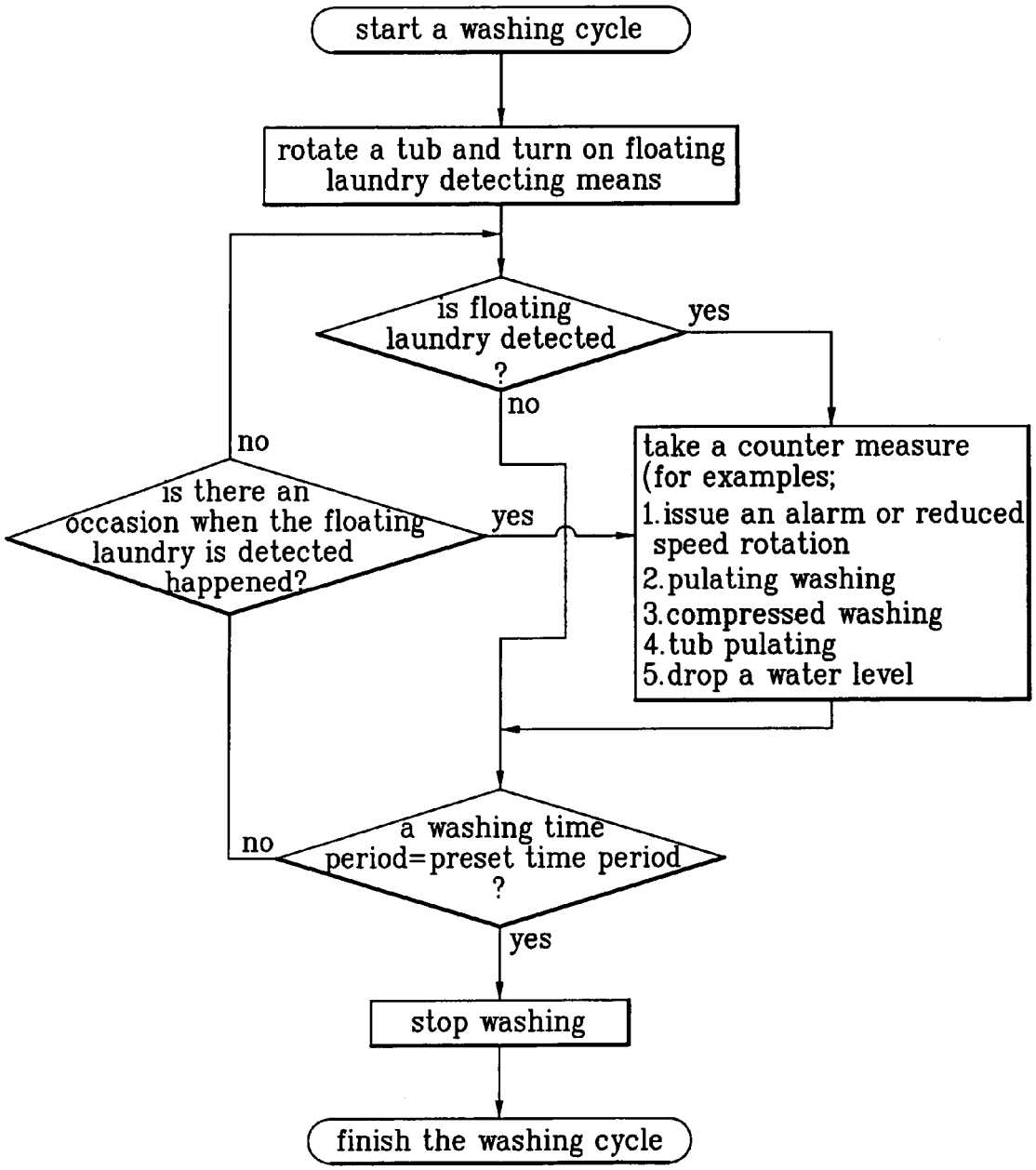
FIG. 11 illustrates a flow chart showing the steps of a process for controlling a washing cycle in a method for controlling a washing machine in accordance with a second embodiment of the present invention.

In the method described in FIG. 11, rotation of a tub is started, and at the same time, the floating laundry detecting means is turned on to detect if there is floating laundry. As a result, if it is determined that there is floating laundry by the detection of the floating laundry detecting means, a counter measure is taken for prevention of splash of the water.

While carrying out the counter measure for prevention of splashing of the water, whether a preset washing time period has been satisfied is checked.

As a result of this, if floating laundry is detected and the washing time period has not reached to the preset washing time period yet, the counter measure for prevention of splashing of the water is conducted continuously. If the washing time period has reached the preset washing time period, the washing is stopped and the washing cycle is finished.

In the meantime, in above process, the counter measure for prevention of splashing of the water may be reduction of rotation speed of the washing tub 3. The counter measure for prevention of splashing of the water may be stopping of the washing tub 3 while pulsating the pulsator 5 only. The counter measure for prevention of splashing of the water may be rotation of the washing tub 3 at a reduced speed in a reverse direction while pulsating the pulsator 5.

Or, in above process, the counter measure for prevention of splashing of the water may be rotation of the washing tub 3 at a speed at which a compressed washing can be performed. The speed at which a compressed washing can be made is a level of speed at which, the laundry, the washing water, and the tub rotate almost at the same speed even though a 'V' formed water circulation is formed by a centrifugal force, the water is not sprayed into the washing tub 3 again through the tub cover 8.

Or, in above process, the counter measure for prevention of splashing of the water may be pulsation of the washing tub 3.

Or, in above process, the counter measure for prevention of splashing of the water may be dropping of the water level by draining the water. It is required that the draining for prevention of the water splash is made to a water level at which there is no floating laundry detected when the washing tub 3 is rotated at the highest speed, even though there may be the water spray through the tub cover 8. As another method of the draining for prevention of the water splash, the draining may be made to leave only a minimum level of water at which no spray of water through the tub cover 8 occurs even if the washing tub 3 is rotated at the highest speed.

Or, in above process, the counter measure for prevention of splash of the water may be stopping of the washing.

A process for controlling a rinsing cycle in a method for controlling a washing machine in accordance with another embodiment of the present invention will be described, with reference to FIG. 12.

Figure 12:
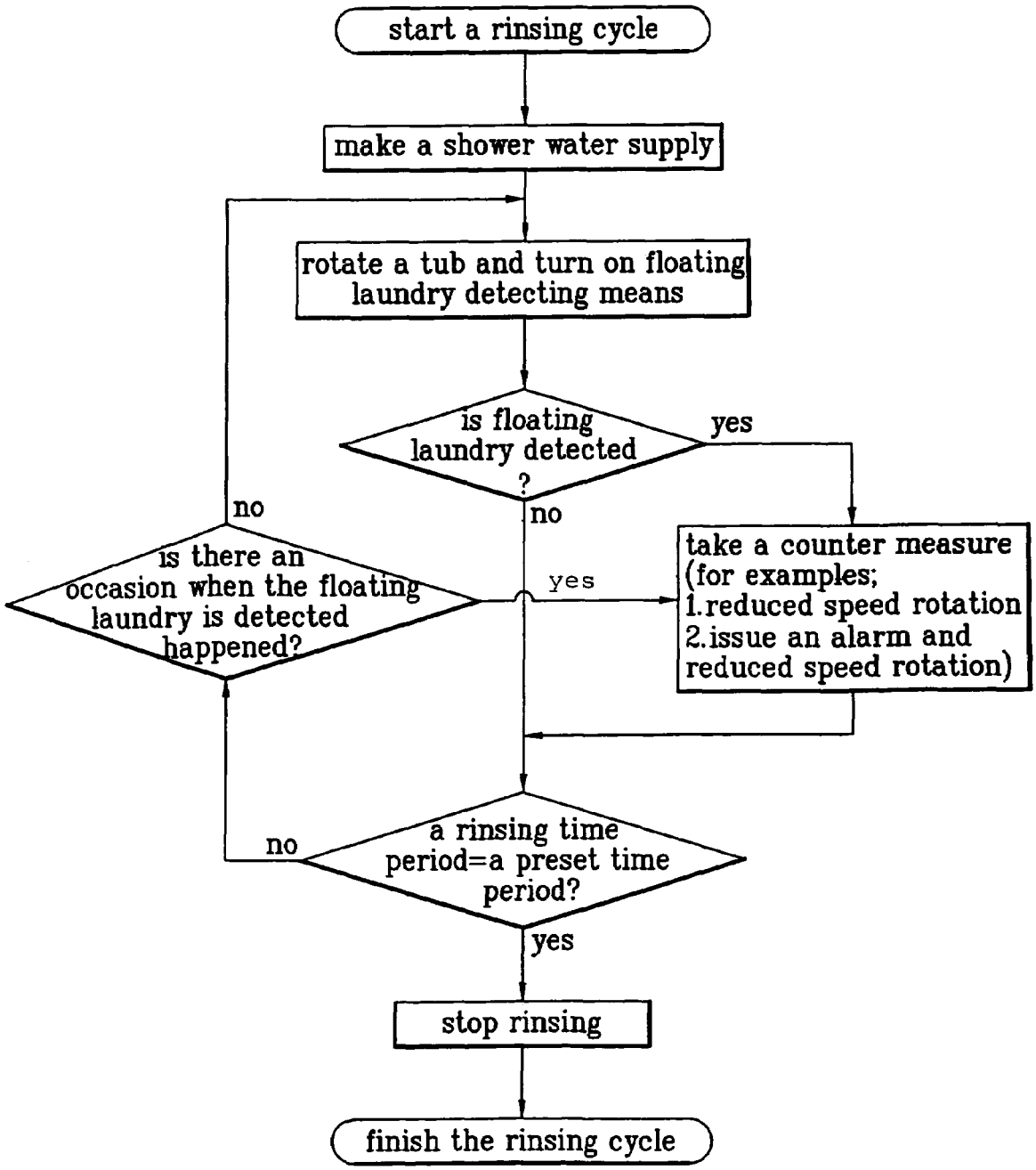
FIG. 12 illustrates a flow chart showing the steps of a process for controlling a rinsing cycle in a method for controlling a washing machine in accordance with a third embodiment of the present invention.

In the method described in FIG. 12, rotation of a tub is started, and at the same time, the floating laundry detecting means is turned on to detect if there is floating laundry. As a result, if it is determined that there is floating laundry by the detection of the floating laundry detecting means, a counter measure is taken for prevention of splash of the water.

While carrying out the counter measure for prevention of splash of the water, whether a preset rinsing time period has been satisfied is checked.

In this instance, if floating laundry is detected and the rinsing time period has not reached to the preset rinsing time period yet, the counter measure for prevention of splashing of the water is conducted continuously. If the rinsing time period has reached the preset rinsing time period, the rinsing is stopped and the rinsing cycle is finished.

In the meantime, in above process, the counter measure for prevention of splashing of the water may be reduction of rotation speed of the washing tub 3. Or, in above process, the counter measure for prevention of splashing of the water may be reduction of a rotation speed of the washing tub 3, while issuing an alarm. Or, in above process, the counter measure for prevention of splashing of the water may be stopping of the rinsing.

In the meantime, another method for controlling a rinsing cycle of the present invention may includes the steps of performing shower supply, starting tub rotation and at the same time with this turning on the floating laundry detecting means to detect whether there is floating laundry or not, taking a counter measure for prevention of water splash when the floating laundry is detected, checking whether a rinsing time period has reached a preset rinsing time period, determining, when the floating laundry is detected, if the rinsing time period has not reached to the present rinsing time period to take the counter measure for prevention of water splash continuously, if the rinsing time period has reached the preset ringing time period, and stopping the rinsing and finishing the rinsing cycle.

In this case too, as disclosed in the process of controlling a rinsing cycle, the counter measure for prevention of water splash may be reduction of the rotation speed of the washing tub 3, reduction of the rotation speed of the washing tub 3 while issuing an alarm, or stopping of the rinsing.

Figure 13:
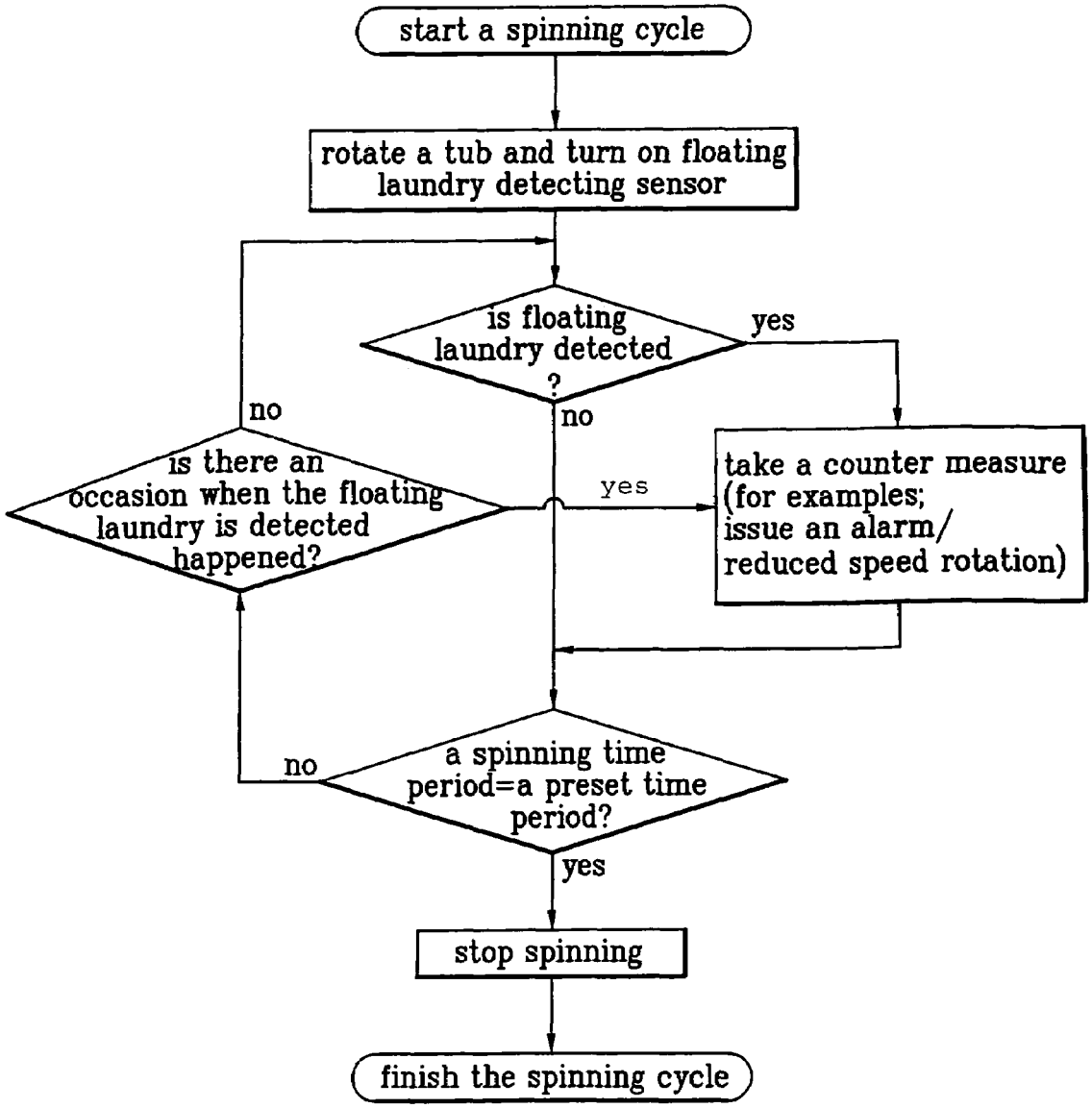
FIG. 13 illustrates a flow chart showing the steps of a process for controlling a spinning cycle in a method for controlling a washing machine in accordance with a fourth embodiment of the present invention.

Finally, a process for controlling a spinning cycle in a method for controlling a washing machine in accordance with another embodiment of the present invention will be described with reference to FIG. 13.

Rotation of a tub is started, and at the same time, the floating laundry detecting means is turned on to detect if there is floating laundry. As a result, if it is determined that there is floating laundry by the detection of the floating laundry detecting means, a counter measure is taken for prevention of damage of cloths and wear down of the tub cover 8.

While carrying out the counter measure for prevention of splash of the water, whether a preset spinning time period has been satisfied is checked.

In this instance, if which floating laundry is detected and the spinning time period has not reached to the preset spinning time period yet, the counter measure for prevention of damage to cloths and wear down of the tub cover 8 is conducted continuously. In a case the spinning time period has reached to the preset spinning time period, the spinning is stopped and the spinning cycle is finished.

In the meantime, in above process, the counter measure for prevention of damage to cloths and wear down of the tub cover 8 may be reduction of rotation speed of the washing tub 3. Or, in above process, the counter measure for prevention of damage to cloths and wear down of the tub cover 8 may be reduction of a rotation speed of the washing tub 3, while issuing an alarm. Or, in above process, the counter measure for prevention of damage to cloths and wear down of the tub cover 8 and splashing of the water may be stopping of the spinning.

It will be apparent to those skilled in the art that various modifications and variations can be made in the present invention without departing from the spirit or scope of the invention.

That is, the device for detecting floating laundry in accordance with any one of different embodiments of the present invention is applicable regardless of a tub rotating type or water penetration type washing machine, or a unitary pulsator type or separated pulsator type washing machine, and position and number of fitting of the floating laundry detecting means may be differ as necessary.

As the floating laundry detecting means of the present invention, not only the optical sensor with the light emitting part 50*a* and the light receiving part 50*b*, but also the ultrasonic sensor, can be employed, and any kinds of sensor may also be employed as far as the sensor can detect floating of laundry over a preset height.

Thus, it is intended that the present invention cover the modifications and variations of this invention provided they come within the scope of the appended claims and their equivalents.

The washing machine, and method for controlling the same of the present invention have the following advantages.

First, different from the related art washing machine, floating of laundry can be detected, permitting to suggest a washing method which can cope with a case when there is floating laundry.

Second, accidents caused by splashing water can be prevented in advance.

Third, deterioration of washing performance and damage to cloths caused by shortage of water coming from floating laundry that splashes water can be prevented.

Fourth, waste of water caused by shortage of water coming from floating laundry that splashes water can be prevented.

At the end, the foregoing various advantages improve product reliability.

What is claimed is:

1. A washing machine, comprising:

an outer case;

a water storage tub inside of the outer case;

a washing tub rotatably mounted inside of the water storage tub;

a driving motor for rotating the washing tub; and floating laundry detecting means that emits a beam of light for detecting when the laundry reaches a preset position in the washing tub, wherein the floating laundry detecting means includes:

a light emitting part and a light receiving part adjacent to each other at one side of the tub cover on top of the water storage tub so as to slant a light path, with respect to a top edge of the tub cover, and a reflective plate at an outside circumference of a fluid balance provided at an upper part of the washing tub, with a slope so as to face the light emitting part and the light receiving part.

* * * * *